US006257800B1

(12) United States Patent
Masters

(10) Patent No.: US 6,257,800 B1
(45) Date of Patent: Jul. 10, 2001

(54) FIBERGLASS MUDMAT ASSEMBLY

(75) Inventor: Rodney H. Masters, Houston, TX (US)

(73) Assignee: AIMS International, Inc., Houston, TX (US)

( * ) Notice: Subject to any disclaimer, the term of this patent is extended or adjusted under 35 U.S.C. 154(b) by 0 days.

(21) Appl. No.: 09/439,532

(22) Filed: Nov. 12, 1999

(51) Int. Cl.[7] ..... E02B 17/02
(52) U.S. Cl. ..... 405/224; 405/226; 405/195.1
(58) Field of Search ..... 405/224, 226, 405/195.1, 203, 201, 207, 211, 211.1, 227, 228, 274

(56) References Cited

U.S. PATENT DOCUMENTS

| | | | | |
|---|---|---|---|---|
| 2,995,900 | * | 8/1961 | Hunsucker | 405/224 |
| 3,064,437 | * | 11/1962 | Knapp | 405/224 |
| 3,638,436 | | 2/1972 | Pogonowski | 61/46.5 |
| 4,307,977 | | 12/1981 | Haney | 405/227 |
| 4,720,214 | | 1/1988 | Brasted et al. | 405/227 |
| 4,863,315 | * | 9/1989 | Wickberg | 405/274 |
| 4,917,195 | | 4/1990 | Harper et al. | 175/7 |
| 5,333,971 | * | 8/1994 | Lewis | 405/274 |
| 6,004,075 | * | 12/1999 | Haas | 405/224 |

OTHER PUBLICATIONS

Offshore Structural Polymers, Inc. product brochure for OSPolyMAT plastic mudmat. (undated).

* cited by examiner

*Primary Examiner*—David Bagnell
*Assistant Examiner*—Frederick L. Lagman
(74) *Attorney, Agent, or Firm*—Fulbright & Jaworski L.L.P.

(57) ABSTRACT

A mudmat assembly for supporting a portion of a subsea offshore platform on a soft, unconsolidated underwater surface is described. The mudmat assembly includes at least one fiberglass plank, a mudline framing plane that is attached to and provides support for the fiberglass plank, and integral framing beams attached to and providing support for the fiberglass plank. The fiberglass mudmat assembly of the present invention requires minimal cathodic protection, has a high flexural strength, and is lighter than conventional mudmats.

11 Claims, 5 Drawing Sheets

FIBERGLASS MUDMAT ASSEMBLY

FIELD OF THE INVENTION

This invention relates to marine structures and, more particularly, to an apparatus and method for supporting a marine structure on a soft, unconsolidated underwater floor during the installation of the structure.

BACKGROUND OF THE INVENTION

Various types of structures are used to extract oil and gas from offshore reservoirs. Most of these structures include a horizontal working platform that is supported at a safe distance above the water's surface by a support device. These support devices include floatation devices that are held in place with anchors, temporarily installed submergible devices, and permanently installed submergible devices. A typical permanently installed support device for an offshore platform consists of long piles that are driven into the underwater floor using a jacket.

The jacket of an offshore platform is that portion of the platform that rests on the underwater floor and through which piles are driven to permanently support the entire platform. It includes hollow pile sleeves that serve as guides for driving the piles and that assure that each pile will be properly placed. In addition to the pile sleeves, the jacket includes many horizontal, vertical, and diagonal supports that provide support for the piles against lateral loads.

Many offshore areas have very soft, unconsolidated underwater floors, which present challenging problems with regard to jacket installation. In particular, after the jacket has been lowered to the sea floor, it is often very difficult to perform the pile driving operations since the jacket tends to sink into the soft mud around the area of the jacket surrounding the pile that is currently being driven. This problem is typically resolved by attaching mudmats to the bottom of the jacket.

Mudmats are used to support the jacket structure of an offshore platform during installation of the platform. In particular, the mudmats have a large area and are thereby able to distribute the load of the jacket over that large area. This allows the jacket to stand on the soft underwater floor and remain stable during the pile driving operations, which typically last 3 to 4 days, but may last as long as three weeks during problematic installations. Mudmats, thus, are an integral part of the mudline framing plane, which is the lowest level of framing in the jacket.

Conventional steel mudmats consist of the major steel pipe members of the mudline framing plane, the mudmat skin or planking, and the integral mudmat framing beams (which support the mudmat planking and which arc typically steel wide flange beams, but may also be steel pipe). Conventional mudmat planking is typically flat steel plate, stiffened steel plate, or crimped steel plate or sheet piling.

There are several disadvantages to using conventional steel skinned mudmats. First, the steel skin for the mudmats is heavy (typically 15.3 psf in air and 13.3 psf submerged). Second, since conventional mudmats are made of steel, they must be protected cathodically. This need for cathodic protection is present despite the mudmats' short useful life since conventional mudmats continue to draft from the platform's cathodic protection after their usefulness has ended. Third, due to their need for cathodic protection, conventional steel mudmats require the placement of additional anodes even when the mudmats are no longer serving any useful purpose. Each additional anode increases the cost of the mudmat system by about $1500 and increases the weight of the jacket by about 900 pounds.

Thus, there is a need for a mudmat that is made of a non-corroding material and hence does not require as much cathodic protection. Further, such mudmats should preferably have a high flexural strength and be lightweight.

Accordingly, it is an object of the present invention to provide a mudmat that does not require as much cathodic protection, has a high flexural strength, and that is lighter than conventional mudmats.

SUMMARY OF THE INVENTION

In accordance with the present invention, a fiberglass mudmat assembly is provided that meets the requirements listed above. In an embodiment of the invention, a fiberglass mudmat is provided having at least one fiberglass plank, a mudline framing plane that is attached to and provides support for the fiberglass plank or planks, and has integral mudmat framing beams that are attached to and provide support for the fiberglass plank or planks.

The present invention also provides for a mudmat assembly for supporting a portion of a subsea offshore platform on a soft, unconsolidated underwater surface. The mudmat assembly includes a plurality of fiberglass planks; a plurality of supporting beams; a mechanism for attaching said fiberglass planks to said framing beams; a plurality of integral framing beams; and, a mechanism for attaching said fiberglass planks to said integral framing beams.

A method is provided for the construction of an assembly that supports a jacket on a soft unconsolidated underwater surface during the installation of an offshore platform. The steps of the method consists of providing a jacket with a plurality of pile sleeves, providing a plurality of fiberglass mudmats, and supporting the pile sleeves with fiberglass mudmats.

BRIEF DESCRIPTION OF THE DRAWINGS

For a more complete understanding of the present invention and advantages thereof, reference is now made to the following description taken in conjunction with the accompanying drawings in which like reference numbers indicate like features, and wherein.

DETAILED DESCRIPTION OF THE PREFERRED EMBODIMENTS

Figure 1:
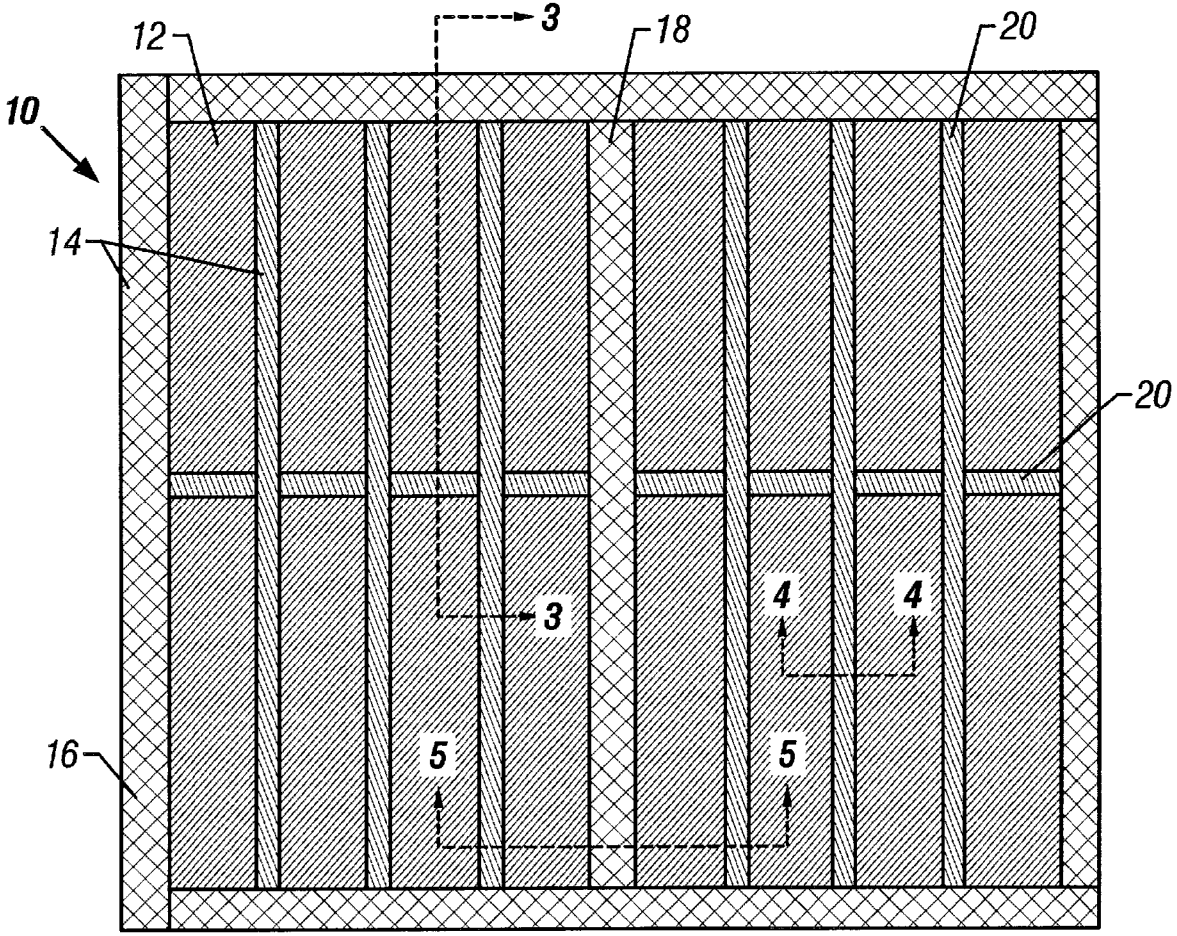
FIG. 1 illustrates a top plan view of a fiberglass mudmat assembly according to the present invention.

The present invention is directed to a fiberglass mudmat assembly 10 that is used in the construction of offshore oil and gas platforms. The mudmat assembly 10 is constructed with fiberglass mudmat planking 12 that is supported by a mudline framing plane 14, as illustrated in FIG. 1. The framing plane 14 can be formed with edge steel pipes 16 and an optional center steel member 18 that supports the mudmat planking 12 and integral framing beams 20. In one embodiment, the fiberglass planks 12 are supported by edge brackets 22 attached to edge pipes 16, by bottom brackets 24 on framing beams 20, and by center brackets 26 attached to center member 18, as illustrated in FIG. 2.

Figure 2:
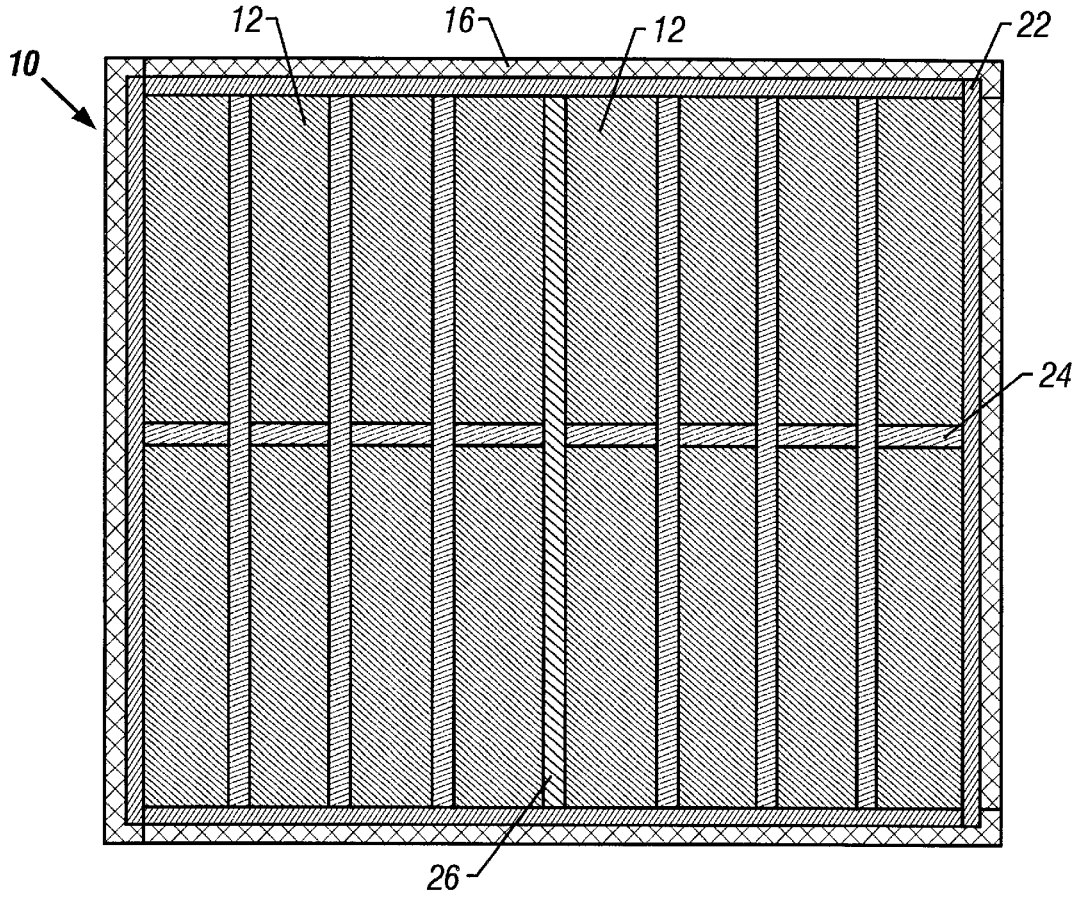
FIG. 2 illustrates a bottom plan view of the fiberglass mudmat assembly of FIG. 1.

Although the framing plane 14 is illustrated as being generally rectangular in FIG. 1 and FIG. 2, many different configurations are possible with various (possibly non-rectangular) shapes and different numbers and types of edge and center pipes. Similarly, different configurations of the framing beams 20 can be used in accordance with the present invention. The dimensions of the mudmat assembly typically can range from about 10 feet×10 feet to 50 feet×50 feet. The weight of the fiberglass mudmat assembly is typically 12–15 psf in air and 10–15 psf submerged.

Figure 3:
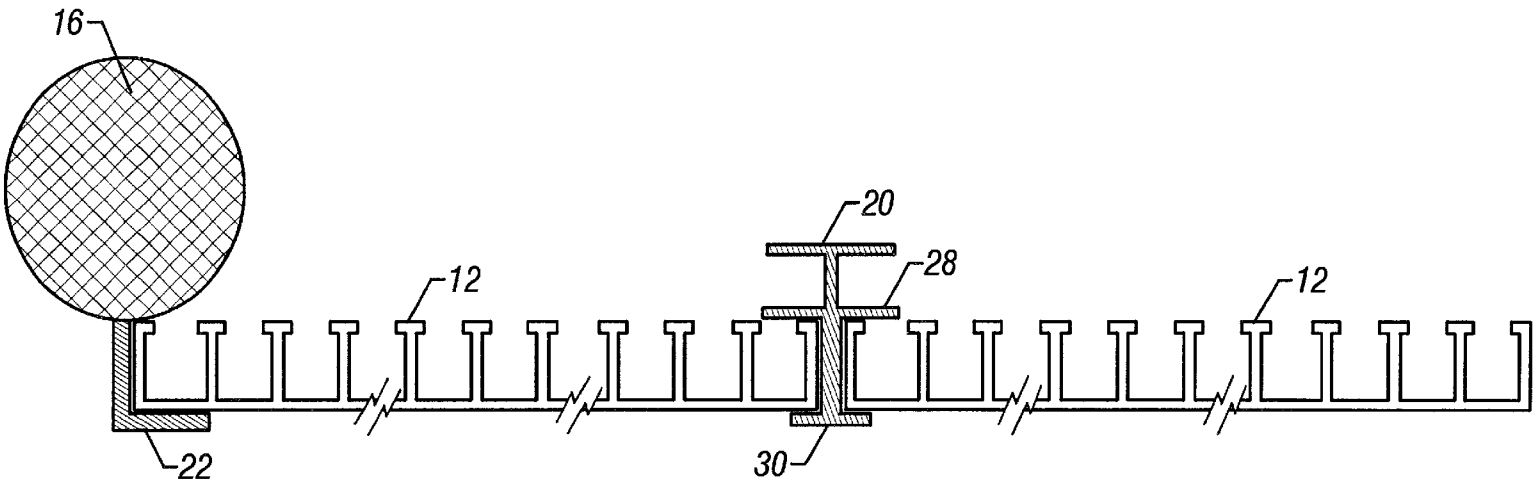
FIG. 3 illustrates a cross sectional view of a section of the fiberglass mudmat assembly taken along line 3—3 of FIG. 1.
Figure 4:
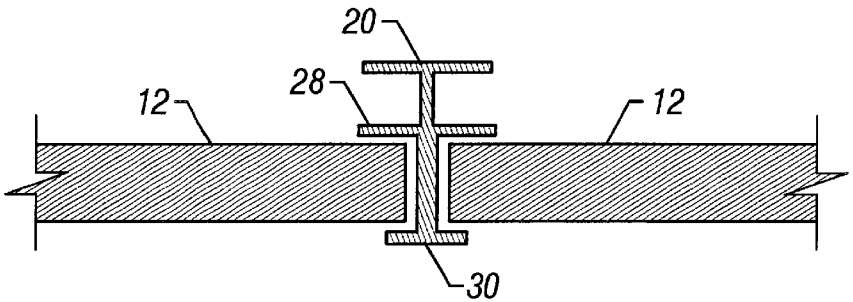
FIG. 4 illustrates a cross sectional view of a section of the fiberglass mudmat assembly taken along line 4—4 of FIG. 1.
Figure 5:
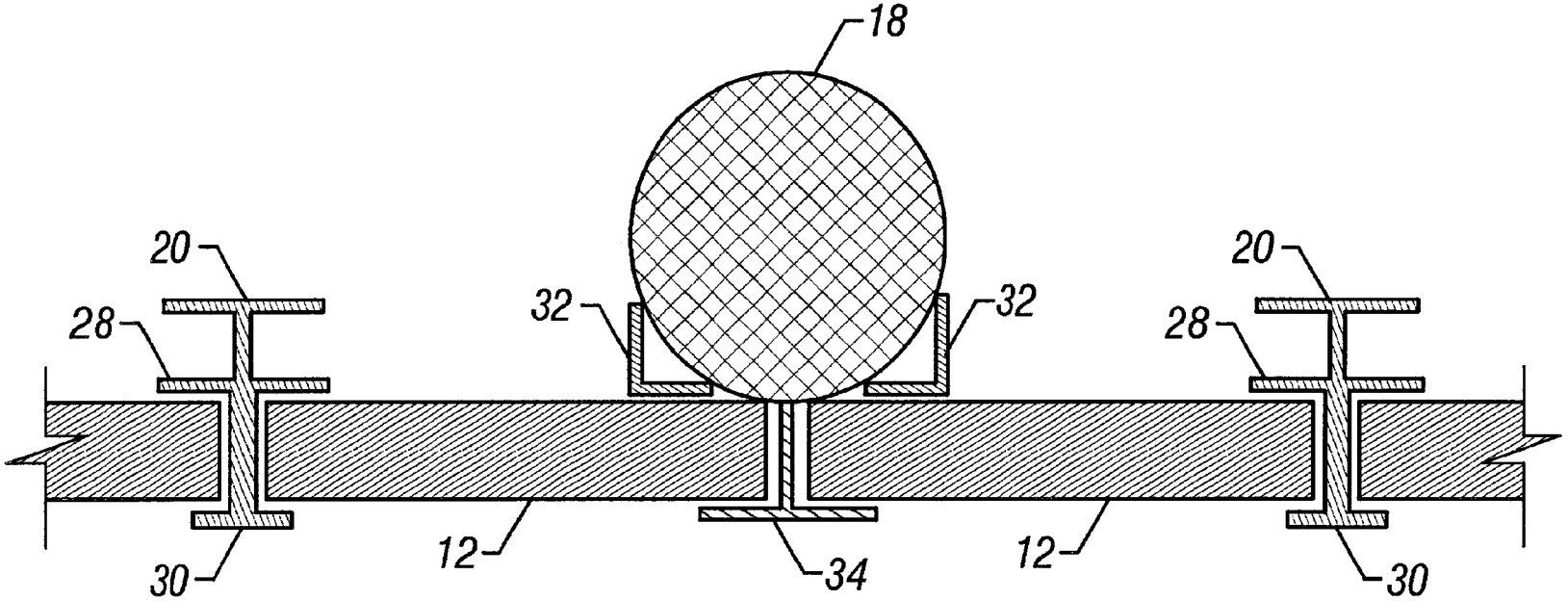
FIG. 5 illustrates a cross sectional view of a section of the fiberglass mudmat assembly taken along line 5—5 of FIG. 1.

Edge brackets 22 and framing beams 20 provide support to planking 12 in which edge bracket 22 is attached to edge pipe 16 (FIG. 3). In one illustrated embodiment, the framing beam 20 provides an upper bracket 28 and a lower bracket 30 into which the planking 12 is inserted (FIG. 4). Also, as shown in FIG. 5, center pipes 18 can be provided with upper and lower brackets 32, 34 respectively, in order to provide additional support for planking 12.

The fiberglass mudmat plank 12 according to the present invention is formed from a coated plate fiberglass laminate. The fiberglass planking 12 can be manufactured by a pultrusion process known to one skilled in the art. A pultruded fiberglass structural shape consists of reinforcing fibers and resin. The fiber reinforcement provides structural stiffness, and the resin provides ultra-violet resistance, chemical resistance, impact resistance, and fire resistance, as well as resistance to other environmental factors. Resins typically contain fillers to assist in achieving an intended performance characteristic. Reinforcing fibers consist of continuous strand mat and continuous strand roving. The pultrusion process is complete once the reinforcing fibers are coupled with the resin and a surfacing veil. Typical structural shapes contain from 45% to 75% reinforcement by weight.

A variety of continuous and woven reinforcement fibers are commonly used in fiberglass pultrusions including primarily E-Glass, S-Glass, aramid, and carbon. The most commonly used reinforcement is E-Glass. Other reinforcements are more costly, and hence are less commonly used in construction. E-Glass has a density of 0.094 lbs/in$^3$, a tensile strength of 500,000 psi, a tensile modulus of $10.5\times10^6$ psi, and a 4.8% elongation to break. S-Glass has a density of 0.090 lbs/in$^3$, a tensile strength of 665,000 psi, a tensile modulus of $9.0\times10^6$ psi, and a 2.3% elongation to break. Aramid has a density of 0.053 lbs/in$^3$, a tensile strength of 400,000 psi, a tensile modulus of $9.0\times10^6$ psi, and a 2.3% elongation to break. Carbon has a density of 0.064 lbs/in$^3$, a tensile strength between 275,000 and 450,000 psi, a tensile modulus between $33\times10^6$ and $55\times10^6$ psi, and an elongation to break between 0.6% and 1.2%.

Continuous strand mat consists of long glass fibers that are intertwined and bound with a small amount of resin, called a binder. It provides the most economical method of obtaining a high degree of transverse or bi-directional strength characteristics. These mats are layered with roving, and this process forms the basic composition found in most pultruded products. The ratio of mat to roving determines the relationship of transverse to longitudinal strength characteristics. In continuous strand roving, each strand contains from 800 to 4,000 fiber filaments. Many strands are used in each pultrusion profile. This roving provides the high longitudinal strength of the pultruded product. The amount and location of these "rovings" can and does alter the performance of the product. Roving also provides the tensile strength needed to pull the other reinforcements through the manufacturing die.

Since pultrusion is a low-pressure process, fiberglass reinforcements normally appear close to the surface of the product. This can affect appearance, corrosion resistance, and handling of the products. Surface veils can be added to the laminate construction, and, when used, displace the reinforcement from the surface of the profile, thereby creating a resin-rich surface. The two most commonly used veils are E-Glass and polyester.

Resin formulations typically consist of polyesters, vinyl esters, and epoxies. Further, they can be chosen to be either fire retardant or non-fire retardant. Polyesters and vinyl esters are the two primary resins used in the pultrusion process. Epoxy resins are typically used wit carbon fiber reinforcements in applications where higher strength and stiffness characteristics are required. Epoxies can also be used with E-Glass for improved physical properties. Polyester resin has a tensile strength of 11,200 psi, an elongation of 4.5%, a flexural strength of 17,800 psi, a flexural modulus of $0.43\times10^6$ psi, a heat distortion temperature of 160° F., and a short beam shear of 4,500 psi. PULTEX® Series 1525 is a fire retardant polyester resin manufactured by Creative Pultrusions, Inc. of Alum Bank, Pa. It possesses a flame spread rating of 25 or less as determined by the ASTM E-84 Tunnel Test, while maintaining good chemical resistance combined with high mechanical and electrical properties. This product is commonly used offshore where fire resistance and moderate corrosion resistance are key elements in the design. For example, it is commonly used in fire retardant structures used offshore such as wellhead access platforms and cable trays.

Figure 6:
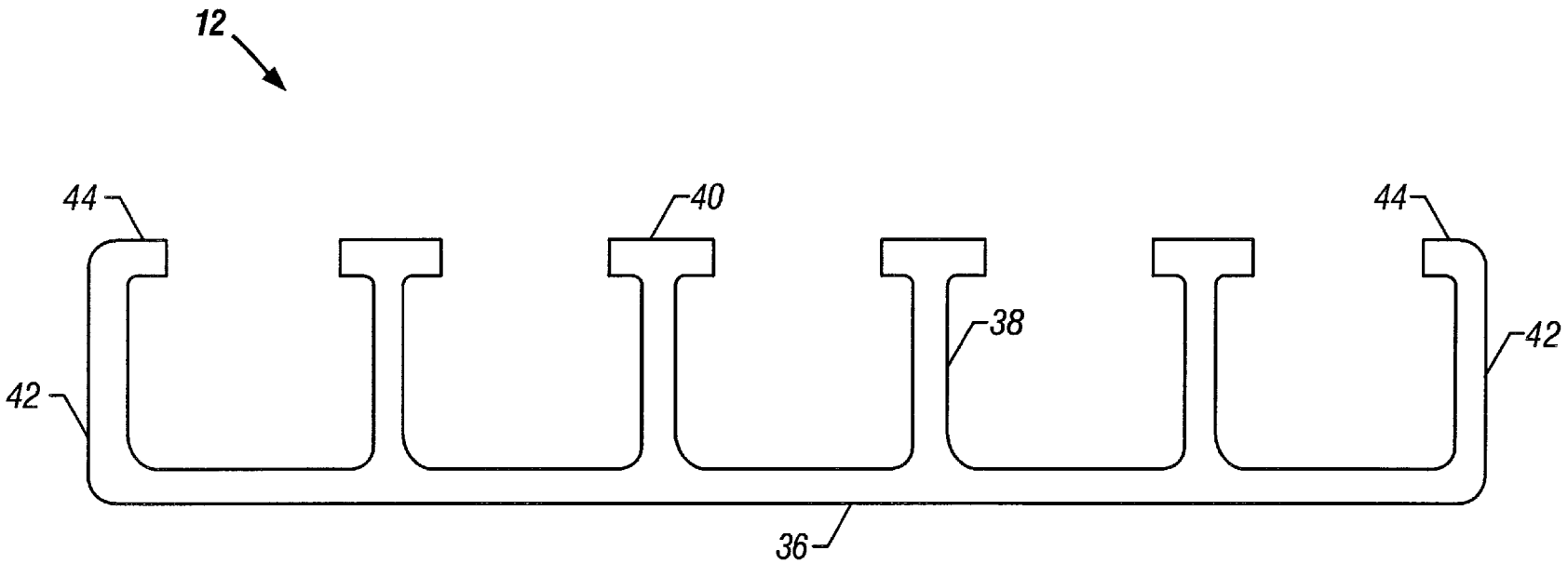
FIG. 6 illustrates a side plan view of the fiberglass mudmat planking of the present invention.

The width and height of each mudmat plank 12 can vary according to the requirements of the jacket structure. In one preferred embodiment, a fiberglass mudmat plank 12 can be constructed having a width of generally about 10¼ inches across, a height of generally about 1⅞ inches, and various lengths as required by the designer. However, other widths and heights can be used. As illustrated in FIG. 6, each plank 12 has a horizontal planar surface 36 and a plurality of interior vertical surfaces 38 that are approximately normal to planar surface 36 and have flanged ends 40. Each plank 12 has two exterior vertical surfaces 42 approximately normal to planar surface 12 and partially flanged ends 44. The small flanges add strength and spread the load out over a greater contact area.

In one embodiment of the present invention, the fiberglass planking 12 has a flexural strength between 60 and 80 ksi. As a result, the fiberglass planking 12 is able to span a longer unsupported distance than unstiffened flat steel plate, thus requiring fewer integral framing beams 20. This reduction in framing beams 20 results in a lower fabrication cost due to the decreased number of required connections. Further, the amount of steel tonnage used is reduced, which produces additional material cost savings.

Thus, the present invention provides a mudmat that does not require as much cathodic protection, has a high flexural strength, and that is lighter than conventional mudmats. Additionally, tremendous cost savings can be realized by using the fiberglass planking 12, of the subject invention that is substantially lighter than conventional steel plate mudmat planking. For example, should the total lift weight of the entire jacket be on the "bubble" when determining a derrick barge's ability to lift and set the jacket, a substantial weight savings could mean that a smaller derrick barge could be used to install the jacket instead of the relatively larger derrick barge required for a conventional installation. This ability to use a smaller barge could result in cost savings up to one million dollars in some situations.

All of the methods and/or apparatus disclosed and claimed herein can be made and executed without undue experimentation in light of the present disclosure. While the devices and methods of this invention have been described in terms of specific embodiments, it will be apparent to those of skill in the art that variations may be applied to the methods and/or apparatus and in the steps or in the sequence of steps of the method described herein without departing from the concept, spirit, and scope of the invention. Therefore, all such substitutions and modifications apparent to those skilled in the art are deemed to be within the spirit, scope, and concept of the invention as defined by the appended claims.

What is claimed is:

1. A mudmat assembly for supporting a portion of a subsea offshore platform on a soft, unconsolidated underwater surface, said mudmat assembly comprising:

at least one fiberglass plank having a planar horizontal member and flanged vertical members that are approximately normal to said planar horizontal member;

a mudline framing plane attached to and providing support for said fiberglass plank; and, integral framing beams attached to and providing support for said fiberglass plank.

2. The mudmat assembly of claim 1, wherein said fiberglass plank has a flexural strength between 60 and 80 ksi.

3. The mudmat assembly of claim 1, wherein said mudline framing plane comprises steel pipe and metal brackets attached to said steel pipe whereby said fiberglass plank is supported.

4. The mudmat assembly of claim 1, wherein said integral framing beams comprise steel wide flanged beams.

5. The mudmat assembly of claim 1, wherein said integral framing beams comprise steel pipes.

6. A mudmat assembly for supporting a portion of a subsea offshore platform on a soft, unconsolidated underwater surface, said mudmat assembly comprising:

a plurality of fiberglass planks, each having a planar horizontal member and flanged vertical members that are approximately normal to said planar horizontal member;

a plurality of supporting beams;

a mechanism for attaching said fiberglass planks to said supporting beams;

a plurality of integral framing beams; and, a mechanism for attaching said fiberglass planks to said integral framing beams.

7. The mudmat assembly of claim 6, wherein said integral framing beams are steel wide flanged beams.

8. The mudmat assembly of claim 6, wherein said integral framing beams are steel pipes.

9. The mudmat assembly of claim 6, wherein said supporting beams are steel pipe.

10. A method of constructing an assembly for supporting a portion of a subsea offshore platform on a soft, unconsolidated underwater surface during the installation of an offshore platform, said method comprising the steps of:

providing a jacket comprising a plurality of pile sleeves;

providing a plurality of fiberglass mudmat assemblies, each assembly providing at least one fiberglass plank having planar horizontal member and flanged vertical members that are approximately normal to said planar horizontal member; and, supporting said pile sleeves with said fiberglass mudmat assemblies during installation.

11. The method of claim 10, wherein said step of providing fiberglass mudmat assemblies further comprises the steps of:

surrounding said fiberglass planking with a steel frame; and, supporting said fiberglass planking within said steel frame with steel beams.

* * * * *